United States Patent [19]

Phillips

[11] Patent Number: 4,525,013

[45] Date of Patent: Jun. 25, 1985

[54] DEMOUNTABLE COAXIAL ELECTRICAL CONNECTOR FOR IN-LINE AMPLIFIERS

[75] Inventor: Raymond J. Phillips, Oakdale, Conn.

[73] Assignee: The United States of America as represented by the Secretary of the Navy, Washington, D.C.

[21] Appl. No.: 571,414

[22] Filed: Jan. 17, 1984

[51] Int. Cl.[3] ..... H01R 39/00

[52] U.S. Cl. ..... 339/7; 339/177 R; 339/252 R

[58] Field of Search ..... 339/2, 7, 177, 59, 60, 339/252–255, 256 S, 64 R, 64 M, 245, 143 R

[56] References Cited

U.S. PATENT DOCUMENTS

| | | | |
|---|---|---|---|
| 1,531,917 | 3/1925 | French | 339/64 M |
| 2,265,006 | 12/1941 | Rubel et al. | 339/64 R |
| 2,971,178 | 2/1961 | Reesby | 339/7 |
| 4,227,765 | 10/1980 | Neumann et al. | 339/143 R |
| 4,468,070 | 8/1984 | Yasuoka | 339/7 |
| 4,469,392 | 9/1984 | Edgerton et al. | 339/7 |

FOREIGN PATENT DOCUMENTS

| | | | |
|---|---|---|---|
| 2266330 | 10/1975 | France | 339/245 |

*Primary Examiner*—Gil Weidenfeld
*Assistant Examiner*—David L. Pirlot
*Attorney, Agent, or Firm*—Robert F. Beers; Arthur A. McGill; Prithvi C. Lall

[57] ABSTRACT

A flexible coaxial connector assembly is used on buoyant cable antenna systems. It comprises a retainer assembly that has threads mating with a bellows assembly. Components that mate in a flexible manner are enclosed by the bellows. An electrical wire passes through these flexible mating components and terminates in a contact pin. The contact pin mates with an amplifier contact socket assembly.

2 Claims, 4 Drawing Figures

DEMOUNTABLE COAXIAL ELECTRICAL CONNECTOR FOR IN-LINE AMPLIFIERS

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The present invention generally relates to an electrical connector and more particularly to a replaceable connector for use with an in-line amplifier assembly. The connector must be compatible with a plurality of existing antenna systems now in use aboard submarines.

(2) Description of the Prior Art

Previously, when damage to the contact components occurred the entire in-line amplifier had to be scrapped and replaced. Because of the unified type construction which includes necessary epoxy encapsulation of the chassis components, most attempts to repair the flexible coaxial components are not successful, and the few that can be salvaged are not done cost-effectively. Almost without exception, the center conductor, at some point in the life of the amplifier, would fatigue and break at the point where it exited the amplifier chassis into the bellows section. Because of construction techniques, size limitations, and accessibility, repairs are thus not possible.

SUMMARY OF THE INVENTION

The present invention provides a replaceable flexible connector for use with an in-line amplifier assembly. The flexible connector has a socket contact at one end and a pin contact at the other end. A wire is connected between these contacts. The wire passes through components that are connected and aligned so as to form a flexible assembly. This flexible assembly forms a portion of the inner conductor in a coaxial cable and is capable of being easily replaced when damaged. The outer conductor comprises a flexible bellows connected between rigid components.

DESCRIPTION OF THE PREFERRED EMBODIMENT

Figure 1:
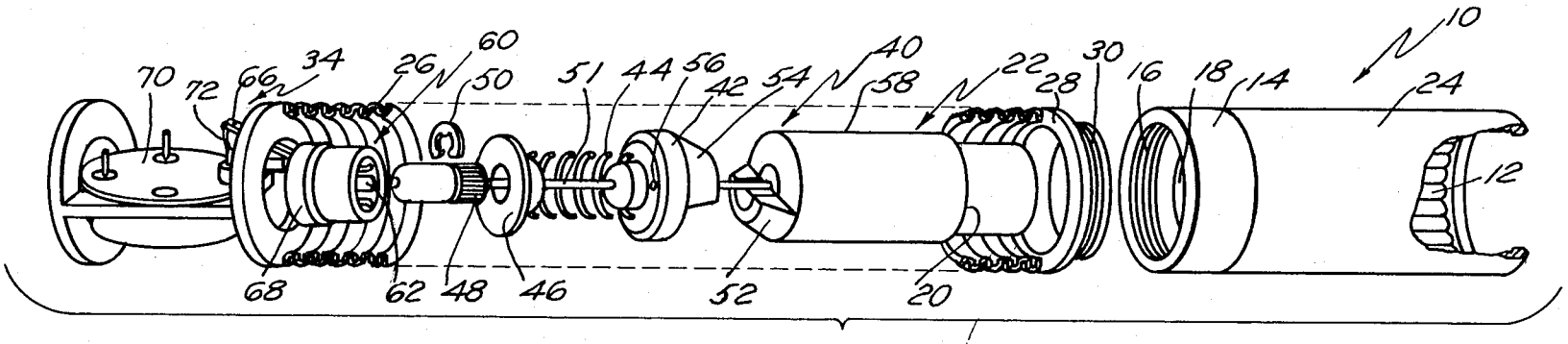
FIG. 1 is an exploded cutaway view of a field replaceable contact assembly for a coaxial cable with connecting components in accordance with the present invention.

Referring now to FIG. 1 there is shown a retainer assembly 10 that forms a part of an outer conductor. The retainer assembly 10 has flexible spring fingers 12 with a ferrule 14 at the opposite end. The ferrule 14 has interior threads 16 and an inside flange 18. The inside flange 18 in assembly abuts wall 20 of insulated contact 22. Insulator sleeve 24 fits over spring fingers 12 and abuts ferrule 14.

A flexible bellows 26 forms another part of the outer conductor. The bellows 26 has at one end a threaded adapter 28 with screw threads 30. The threads 30 mate with threads 16 of retainer assembly 10. The bellows 26 at its other end is attached to a chassis 34.

A flexible coaxial connector 40 is located primarily within flexible bellows 26. Connector 40 is comprised of the aforementioned insulated contact 22, spring cap 42, flexible spring 44, spring seat 46, amplifier contact pin 48 retaining ring 50 and connecting wire 51. The insulated socket 22 has a split end 52 abutting the split end 54 of spring cap 42. The abutting ends 52 and 54 prevent relative rotation between cap 42 and insulated contact 22. The flexible spring 44 at one end fits over spring seat 46 and at the other end is affixed to spring cap 42 by passing the end through an aperture 56. The amplifier contact pin 48 at one end is press fitted into spring seat 46 and held in place by retaining ring 50.

Figure 2:
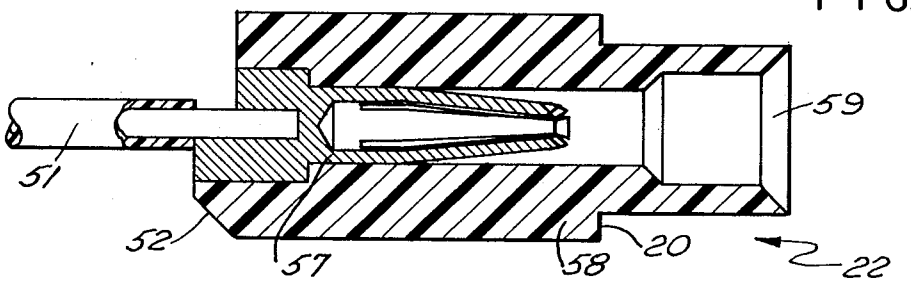
FIG. 2 is a sectional view of the insulated contact of FIG. 1.

A sectional view of the insulated contact 22 is shown in FIG. 2. The wire 51 is soldered to the feedthrough socket 57. The socket 57 is enclosed in an insulating material 58 along its length. The insulator 58 has wall 20 orthogonal to the insulated contact 22 axis. The contact 22 has an aperture 59 at the end opposite wire 51. The contact 22 is shown as having a socket arrangement. However, at the option of the designer a pin could be used to replace socket 57.

Referring now to both FIGS. 1 and 2 it is shown that the wire 51 is connected from socket 57 within insulated contact 22 through spring cap 42, spring 44 and spring seat 46. The wire 51 is then soldered into contact pin 48.

Figure 3:
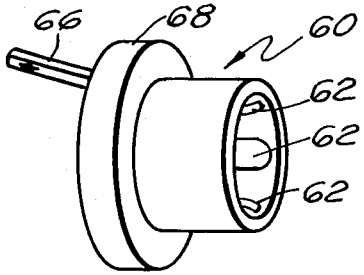
FIG. 3 is a pictorial representation of the amplifier contact socket assembly of FIG. 1.
Figure 4:
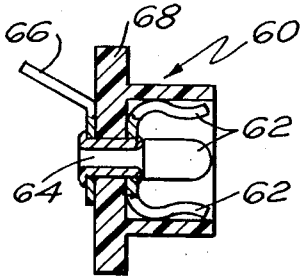
FIG. 4 is a sectional view of the amplifier contact socket assembly of FIG. 1.

The chassis 34 has inserted into it an amplifier contact socket assembly 60 that is shown in FIGS. 1, 3 and 4. The assembly 60 has a contact socket 62 and at its back end a tubular rivet 64 that is connected to a solder lug 66. An amplifier 70 mounted on chassis 34 is connected to solder lug 66 by wire 72. The contact socket 62 is substantially enclosed by a plastic insulator 68. The insulator 68 is affixed to a flange of chassis 34. The contact socket 62 mates with an end of contact pin 48.

Upon failure of the wire 51, the retainer assembly 10 is unscrewed from flexible bellows 26 and the flexible coaxial connector 40 including the insulated socket 22, spring cap 42, flexible spring 44, spring seat 46, amplifier contact pin 48, retaining ring 50 and damaged wire 51 is removed. A new connector 40 has its contact pin 48 inserted in socket 62. The the retainer assembly 10 is then screwed on bellows 26 completing the repairment of the system.

There has therefore been described a system that after being damaged can be quickly returned to service. The system can normally be repaired many times during its life by the above-described replacement procedure. Each time damage occurs one or two thousand dollars is saved by the replacement of a fifteen dollar part.

It will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A flexible electrical connector comprising:

a first assembly including a first contact piece adapted to be demountably connected, said first assembly further includes a spring seat having an aperture in which the first contact piece is press fitted and a retaining ring positioning said first contact piece within said spring seat aperture;

a second assembly including an insulated second contact piece adapted to be demountably connected, said second contact piece having a split end and an electrical feedthrough with the end opposite said split end adapted for receiving an external electrical conductor; and flexible means for providing an electrical conductive bending radius between said first and second contact pieces, said flexible means further including an electrical wire connected between said first contact piece and said split end of said second contact piece, a spring cap having a split end abutting said split end of said second contact piece to prevent relative rotation between said spring cap and said second contact piece, said spring cap further having an aperture for passing therethrough said electrical wire and a flexible spring connecting said spring cap and said spring seat and having said electrical wire passing axially through said spring.

2. A flexible demountable coaxial connector assembly comprising:

an outer conductive path including a cylindrical retainer assembly including spring fingers at one end and a threaded ferrule at the other end, a flexible bellows having one end adapted to be threaded to said threaded ferrule and a chassis connected to the other end of said flexible bellows; and an inner conductive path having first assembly including a first contact piece adapted to be demountably connected, said first assembly further includes a spring seat having an aperture in which the first contact piece is press fitted and a retaining ring positioning said first contact piece within said spring seat aperture, a second assembly including an insulated second contact piece adapted to be demountably connected, said second contact piece having a split end and an electrical feedthrough with the end opposite said split end adapted for receiving an external electrical conductor, flexible means for providing an electrical conductive bending radius between said first and second contact pieces, said flexible means further including an electrical wire connected between said first contact piece and said split end of said second contact piece, a spring cap having a split end abutting said split end of said second contact piece to prevent relative rotation between said spring cap and said second contact piece, said spring cap further having an aperture for passing therethrough said electrical wire and a flexible spring connecting said spring cap and said spring seat and having said electrical wire passing axially through said spring and a contact socket insulator having a contact socket adapted to be demountably connected to said first contact piece, said contact socket insulator connected to said chassis.

* * * * *